United States Patent [19]

Gross et al.

[11] 4,075,802

[45] Feb. 28, 1978

[54] BURGLAR-PROOF WINDOW AND LIKE PANES OF GLASS

[75] Inventors: Marvin H. Gross, Northridge; Alfred Kolb, Sherman Oaks, both of Calif.

[73] Assignee: Transparent Glass Coatings Co., Inc., Los Angeles, Calif.

[21] Appl. No.: 733,138

[22] Filed: Oct. 18, 1976

[51] Int. Cl.[2] ..... E06B 3/28

[52] U.S. Cl. ..... 52/203

[58] Field of Search ..... 52/202, 203, 309.3, 52/309.16; 65/115; 428/44, 45, 46, 49, 77

[56] References Cited

U.S. PATENT DOCUMENTS

| | | | |
|---|---|---|---|
| 2,742,391 | 4/1956 | Warp | 52/309.16 |
| 3,009,845 | 11/1961 | Wiser | 52/203 X |
| 3,427,770 | 2/1969 | Kunert et al. | 52/203 |

FOREIGN PATENT DOCUMENTS

| | | | |
|---|---|---|---|
| 684,537 | 3/1967 | Belgium | 52/202 |
| 567,217 | 12/1958 | Canada | 52/202 |

*Primary Examiner*—J. Karl Bell

*Attorney, Agent, or Firm*—Whann & McManigal

[57] ABSTRACT

A window or similar pane of glass that is rendered burglar-proof by being faced with a relatively thinner film of strong transparent plastic material adhesively secured to said glass pane, the cohesion of the latter being such that while the glass pane may break under the force of blows applied to it or to the outer surface of the film adhesive, the broken pieces of the pane will be retained in their co-planar position adhesively held in place by said film. A reinforcing frame may be provided to firmly hold the four or more circumscribing edges of the film of adhesive secured to the window frame.

2 Claims, 9 Drawing Figures

10a
12
2
2
10
15
14

12
14
15
25
25a
11
10
26

14
15
16
20
12
10
11

14
18
16
12
10
11

14
16
22
21
23
12
10

24
25
21

16
19
14
12

16
8
19
8
14
12

10
26
27
28
12

BURGLAR-PROOF WINDOW AND LIKE PANES OF GLASS

BACKGROUND OF THE INVENTION

Field of the Invention

To render window panes, whether large or small, and of varying thickness and which when treated as above explained, are rendered shatterproof and, therefore, proof against illicit access to the area that is enclosed by the above-mentioned window pane, whether or not broken.

The present applicants have a working knowledge of the industry in which windows and other such structures are produced and allege that the present application has basis on laboratory tests regarding safety of windows.

The primary aspect of the present window construction provides for preventing shattering of windows and minimizing their breakage such as will retain the broken pieces of window panes in place after such panes are broken.

SUMMARY OF THE INVENTION

The invention contemplates rendering a glass pane burglar-proof by coating such a pane with a clear weather-resistant polyethylene, terephthalate film that is treated against ultra-violet rays and with a water reactivatable acrylic adhesive, to render the film resistant to penetration under impacts of missiles such as baseballs, stones and other such objects.

BRIEF DESCRIPTION OF THE DRAWINGS

In the drawings, like reference characters designate similar parts in the several views.

DESCRIPTION OF THE PREFERRED EMBODIMENTS

Figures 1, 2, 3, 4, 5, 6, 7, 8, 9:
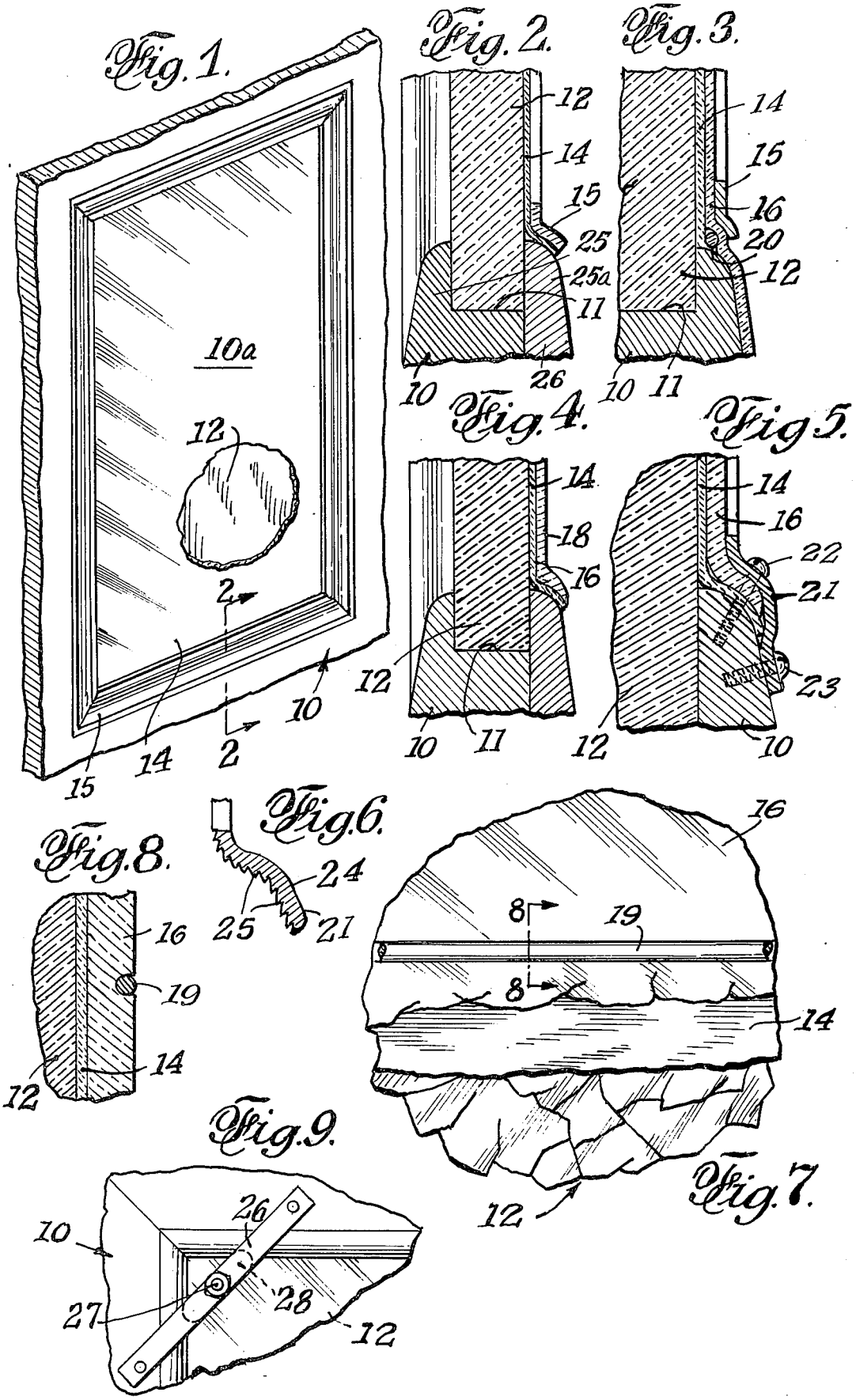
FIG. 1 is a perspective view of a burglar-proof window as seen from the inner side thereof.
FIG. 2 is an enlarged fragmentary sectional view as taken on the line 2—2 of FIG. 1.
FIG. 3 is a similar fragmentary sectional view of an alternate form of the view shown in FIG. 2.
FIGS. 4 and 5 are two additional alternate forms of the window structures shown in FIGS. 2 and 3.
FIG. 6 is a fragmentary sectional view of a variation of an inner corner bracket similar to the one shown in FIG. 5.
FIG. 7 is a fragmentary view of the lower inner side of the window with elements of the window being successively broken away to illustrate the successive plies from the inner toward the outer plies.
FIG. 8 is a cross-sectional view as taken on the line 8—8 of FIG. 7.
FIG. 9 is an additional fragmentary view as seen from the inner side of the window and showing a reinforcing strap at a corner of a window according to the present invention.

As shown in the several views of the drawing, the burglar-proof window construction comprises a circumscribing frame 10 providing a window space **10*a* which, while shown in conventional rectangular form, as in FIG. 1, may be hexagonal, circular, or of certain other forms, as may be desired. FIGS. 2, 3 and 4 show rabbited circumscribing seats 11 in which a glass pane 12, whether or single or double thickness, may be fitted. The glass pane or window 12 is secured in place by a circumscribing molding 26 which completely encircles the window space, the molding being secured to the frame 10, and the outer edges of the window are held between flanges 25 and 25*a***.

As shown in FIGS. 2, 3, 4, 5 and 8, a layer of adhesive 14 is applied to the inner face of the glass pane. As shown in FIG. 2 said adhesive layer 14, in addition to its being adhered to the glass pane, may be retained in place by a frame 15 as shown in FIG. 2.

FIG. 3 shows the above-mentioned adhesive layer 14 as covered by a transparent layer 16 which, in turn, is enclosed by a frame 15 as in FIG. 2. As shown in FIG. 5 the transparent film and the adhesive layer extends onto one of the flanges 25 or **25*a* so that the perimeter portion of the transparent film is firmly secured thereto in order to prevent the edges of the transparent film moving inward toward the central part of the window space 10*a* when any portion of the window 12** is struck a blow.

FIG. 4 is similar to FIG. 2 except that the frame 15 is replaced by a reinforcing glass panel 18 between which and the glass pane the mentioned film is sandwiched.

Certain other features may be incorporated in the window structure. As examples, a reinforcing member, as shown at 19 in FIGS. 7 and 8, as well as a filler member 20 that seals between the adhesive layer 14 and the transparent member 16, as in FIG. 3.

From the viewpoint of structure, FIG. 5 represents improved means comprising the glass pane 12 housed in the frame 10 as before described, the adhesive layer 14, as shown in FIG. 2 and an improved frame 21, as shown in FIG. 5. In these structures, fasteners 22 and 23 are used to secure said frame 21 to the window frame 10. This frame may have its portion 24 provided with serrations 25 in the underface thereof.

The important element of the above-described window-structure is the transparent layer 16 that is comprised of polyethylene terephthalate. This chemical composition is formed from ethylene glycol and terephthalatic acid and has a melting point of 265° C. and a second order transition temperature of 70° to 80° C. This chemical composition is produced as oriented films or fibers characterized by high strength, good electrical properties, and high resistance to moisture.

Impact tests involving coated and uncoated glass panes of both single and double thickness were struck by a professional league baseball at a velocity of 29.5 feet per second with the result that the uncoated glass suffered total disintegration.

With a glass pane of similar thickness, but provided with a film 14, total disintegration did not occur but rather, while the pane broke to a degree commensurate to the force of the blow, the broken pieces did not shatter but remained adhered to the film in window-closing position.

While we have illustrated and described what we now contemplate to be the best mode of carrying out our invention with respect to both the method and window construction, the same is, nevertheless, subject to modification without departing from the spirit and scope of our invention.

We claim:

1. A burglar-proof window construction comprising:

(a) a circumscribing frame surrounding a window space and providing a circumscribing seat adjacent said window space;

(b) a window positioned in said window space and having its outer edges position positioned on said seat;

(c) a molding secured to said frame and providing a holding flange for securing said window in place;

(d) a strong transparent shatter-proof film having qualities to exclude ultra-violet light covering that portion of said window within said window space, the outer edge of said transparent film extending onto said molding on the side opposite from said glass; and (e) an adhesive positioned between said window and said transparent film and edge of said transparent film and said molding, said adhesive securedly fixing said transparent film to said window, and the edge of transparent film to said molding, the securing of the edge of said transparent film to said molding restraining the edges of said transparent film from moving inwardly toward said window space.

2. A window construction as defined in claim 1 in which there is also an auxiliary circumscribing frame engaging said edge portion of said transparent film and said molding and being secured thereto to clamp said edge portion of said transparent film in place so that said adhesive and auxiliary frame cooperate to prevent the edge portion of said transparent film from moving inwardly toward said window space.

* * * * *